US011279149B2

(12) United States Patent
Kaneko et al.

(10) Patent No.: US 11,279,149 B2
(45) Date of Patent: Mar. 22, 2022

(54) LIQUID DISCHARGING APPARATUS

(71) Applicant: SEIKO EPSON CORPORATION, Tokyo (JP)

(72) Inventors: Kenichiro Kaneko, Okaya (JP); Seijun Horie, Matsumoto (JP); Tsuneyuki Sasaki, Matsumoto (JP); Hiroyuki Kobayashi, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/065,049

(22) Filed: Oct. 7, 2020

(65) Prior Publication Data

US 2021/0107299 A1 Apr. 15, 2021

(30) Foreign Application Priority Data

Oct. 9, 2019 (JP) ..... JP2019-186188

(51) Int. Cl.

| | |
|---|---|
| ***B41J 11/00*** | (2006.01) |
| ***B41J 29/17*** | (2006.01) |
| ***B41J 11/02*** | (2006.01) |

(52) U.S. Cl.

CPC ..... *B41J 11/007* (2013.01); *B41J 11/02* (2013.01); *B41J 29/17* (2013.01)

(58) Field of Classification Search

CPC . B41J 29/17; B41J 15/048; B41J 11/02; B41J 11/06; B41J 11/13; B41J 11/14; B41J 11/007

See application file for complete search history.

(56) References Cited

U.S. PATENT DOCUMENTS

| | | | | |
|---|---|---|---|---|
| 2017/0151788 | A1* | 6/2017 | Mizushima | B41J 2/16535 |
| 2017/0282599 | A1* | 10/2017 | Ido | B41J 3/4078 |
| 2020/0276847 | A1* | 9/2020 | Tanchak | B41J 11/06 |

FOREIGN PATENT DOCUMENTS

| | | |
|---|---|---|
| JP | 2001-192136 | 7/2001 |
| JP | 2005-212968 | 8/2005 |
| JP | 2008-170815 | 7/2008 |
| JP | 2009-288287 | 12/2009 |
| JP | 2010-224281 | 10/2010 |
| JP | 2015-043027 | 3/2015 |
| JP | 2018-058283 | 4/2018 |

* cited by examiner

*Primary Examiner* — Scott A Richmond
(74) *Attorney, Agent, or Firm* — Workman Nydegger

(57) ABSTRACT

A liquid discharging apparatus includes a transporting belt having an endless shape stretched over a plurality of rollers and configured to rotate while supporting a medium, to transport the medium in a transport direction, a liquid discharging unit configured to discharge a liquid onto the medium, and a flat plate portion for supporting the transporting belt from a side of a contact face with the roller. the flat plate portion includes an edge extending from one end of the transporting belt to the other end of the transporting belt along an extending direction intersecting the transport direction, the edge being formed by a transporting belt support face for supporting the transporting belt and a face facing upstream in a rotation direction of the transporting belt when transporting the medium in the transport direction. the edge is disposed to abut against the transporting belt along the extending direction.

7 Claims, 9 Drawing Sheets

LIQUID DISCHARGING APPARATUS

The present application is based on, and claims priority from JP Application Serial Number 2019-186188, filed Oct. 9, 2019, the disclosure of which is hereby incorporated by reference herein in its entirety.

BACKGROUND

1. Technical Field

The present disclosure relates to a liquid discharging apparatus.

2. Related Art

In the related art, there has been used a liquid discharging apparatus configured to discharge liquid onto a medium while transporting the medium using a transporting belt having an endless shape that is stretched over a plurality of rollers. For example, JP 2018-58283 A discloses a printing apparatus configured to discharge an ink from a discharging head onto a printing medium while transporting the printing medium using an endless belt stretched over a belt rotating roller and a belt driving roller.

Unfortunately, in the liquid discharging apparatus in the related art configured to discharge liquid onto a medium while transporting the medium using a transporting belt having an endless shape that is stretched over a plurality of rollers as in the printing apparatus disclosed in JP 2018-58283 A, foreign materials such as a mist of the discharged liquid may, for example, adhere to a side of the transporting belt, which makes contact with the roller, to enter into between the transporting belt and the roller. Then, in the related art, when the foreign materials enter into between the transporting belt and the roller, the roller may slip with respect to the transporting belt, and there may be a risk of degrading the transport accuracy. Under such a circumstance, the present disclosure aims to suppress the degradation of the transport accuracy caused by the transporting belt.

SUMMARY

A liquid discharging apparatus of the present disclosure for resolving the above-described issue includes a transporting belt having an endless shape stretched over a plurality of rollers and configured to rotate while supporting a medium, by a support face being a face on an opposite side from a contact face with the roller, to transport the medium in a transport direction, a liquid discharging unit configured to discharge a liquid onto the medium supported by the support face, and a flat plate portion for supporting the transporting belt from a side of the contact face, in which the flat plate portion includes an edge extending from one end of the transporting belt to the other end of the transporting belt along an extending direction intersecting the transport direction, the edge being formed by a transporting belt support face for supporting the transporting belt and a face facing upstream in a rotation direction of the transporting belt when transporting the medium in the transport direction, and in which the edge is disposed to abut against the transporting belt along the extending direction.

DESCRIPTION OF EXEMPLARY EMBODIMENTS

Figure 1:
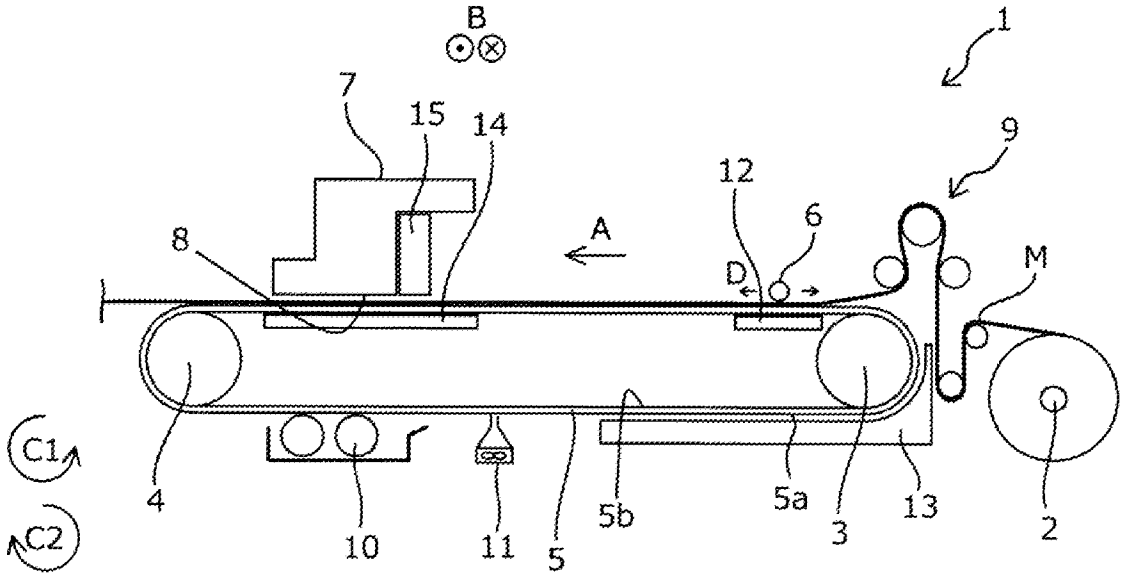
FIG. 1 is a schematic side view of a liquid discharging apparatus according to Example 1 of the present disclosure.

First, the present disclosure will be schematically described.

A first aspect of a liquid discharging apparatus of the present disclosure for resolving the above-described issue includes a transporting belt having an endless shape stretched over a plurality of rollers and configured to rotate while supporting a medium by a support face being a face on an opposite side from a contact face with the roller, to transport the medium in a transport direction, a liquid discharging unit configured to discharge a liquid onto the medium supported by the support face, and a flat plate portion for supporting the transporting belt from a side of the contact face, in which the flat plate portion includes an edge extending from one end of the transporting belt to the other end of the transporting belt along in an extending direction intersecting the transport direction, the edge being formed by a transporting belt support face for supporting the transporting belt and a face facing upstream in a rotation direction of the transporting belt when transporting the medium in the transport direction, in which the edge is disposed to abut against the transporting belt along the extending direction.

According to the above aspect, the edge formed at the flat plate portion, which is disposed to abut against the transporting belt along the extending direction, can remove foreign materials from the contact face. This makes it possible to suppress the roller from slipping with respect to the transporting belt to degrade the transport accuracy, and to suppress the degradation of the transport accuracy caused by the transporting belt.

A liquid discharging apparatus of a second aspect of the present disclosure is the above-described first aspect, in which the edge is provided at an upstream end of the flat plate portion.

According to the above aspect, a configuration in which the edge is provided at the upstream end of the flat plate portion facilitates a formation of the edge.

A liquid discharging apparatus of a third aspect of the present disclosure is the above-described first aspect, in which the flat plate portion includes a groove provided along the extending direction, and the edge is formed by the transporting belt support face and a face facing the upstream in the groove.

According to the above aspect, the groove of the flat plate portion, which is provided with the edge, can receive foreign materials removed by the edge.

A liquid discharging apparatus of a fourth aspect of the present disclosure is any one of the above-described first to third aspects, in which the extending direction in which the edge extends is out of alignment with respect to a width direction of the transporting belt, the width direction being orthogonal to the transport direction.

According to the above aspect, the extending direction in which the edge extends is out of alignment with respect to the width direction of the transporting belt, thus allowing, in conjunction with causing the transporting belt to rotate, foreign materials removed by the edge to automatically move to a width direction end portion located downstream in the rotational direction. This makes it possible to facilitate a movement of the foreign materials removed by the edge, and to suppress the foreign materials from accumulating at the edge.

A liquid discharging apparatus of a fifth aspect of the present disclosure is any one of the above-described first to fourth aspects, in which a foreign material receiving section for receiving a foreign material adhering to the edge is provided.

According to the above aspect, the foreign material receiving section for receiving the foreign materials adhering to the edge is provided to suppress the foreign materials from being scattered inside the apparatus to cause a contamination and the like inside the apparatus.

A liquid discharging apparatus of a sixth aspect of the present disclosure includes, in the above-described fifth aspect, a movement section configured to move the foreign material adhering to the edge toward the foreign material receiving section.

According to the above aspect, the movement section configured to move the foreign materials adhering to the edge toward the foreign material receiving section allows the foreign materials to be received by the foreign material receiving section with high accuracy, and to efficiently suppress the foreign materials from being scattered inside the apparatus to cause a contamination and the like inside the apparatus.

A liquid discharging apparatus of a seventh aspect of the present disclosure includes, in the above-described fifth or the sixth aspect, a cleaning section configured to clean the transporting belt, in which the cleaning section also serves as the foreign material receiving section.

According to the above aspect, the cleaning section also serves as the foreign material receiving section, thus enabling to suppress, by separately forming the cleaning section and the foreign material receiving section, the apparatus configuration from being complexed.

A liquid discharging apparatus of an eighth aspect of the present disclosure is any one of the above-described first to seventh aspects, in which the flat plate portion is provided at a position facing the liquid discharging unit.

According to the above aspect, the flat plate portion, which is provided at the position facing the liquid discharging unit, can suppress the transporting belt and the medium supported by the transporting belt from being vibrated, and to thus suppress the discharge position from which the liquid is discharged from being displaced from a desired position due to the vibration of the medium. This makes it possible to suppress the degradation of the transport accuracy caused by the transporting belt, as well as to suppress the discharge position from being displaced from the desired position.

A liquid discharging apparatus of a ninth aspect of the present disclosure is any one of the above-described first to seventh aspects, in which the transporting belt has an adhesive applied at the support face, and the medium is transported in a state of being affixed by the adhesive to the support face at least from an affixation position at which the medium is affixed to a position where the medium passes a region facing the liquid discharging unit, in which at the affixation position, a press roller configured to press the medium against the support face and the flat plate portion provided at a position facing the press roller are formed.

According to the above aspect, the flat plate portion, which is provided at the position facing the press roller, allows the medium to be pressed against the support face in a manner clamping the medium and the transporting belt between the press roller and the flat plate portion, and to make the medium firmly affixed to the support face. This makes it possible to suppress the degradation of the transport accuracy caused by the transporting belt, as well as to suppress the occurrence of affixing failure of the medium with respect to the support face.

Example 1

Embodiments according to aspects of the present disclosure will be described below with reference to the accompanying drawings. First, an overview of a liquid discharging apparatus 1 according to Example 1 of the present disclosure will be given with reference to FIG. 1.

As illustrated in FIG. 1, the liquid discharging apparatus 1 of Example 1 includes a transporting belt 5 configured to rotate in a rotation direction C1 to transport a medium M in a transport direction A. The liquid discharging apparatus 1 also includes a feeding-out unit 2 configured, by setting the medium M in a rolled form, to rotate in the rotation direction C1 to feed out the medium M. The transporting belt 5 is configured to transport, in the transport direction A, the medium M fed-out from the feeding-out unit 2 via a group of rollers 9. The transporting belt 5 is an endless belt stretched over a driven roller 3 located upstream in the transport direction A and a driving roller 4 located downstream in the transport direction A.

Here, the transporting belt 5 is an adhesive belt applied with an adhesive on a support face 5*a* serving as an outside surface. As illustrated in FIG. 1, the medium M is transported while being supported by the transporting belt 5 in a state where the medium M is affixed to the support face 5*a* applied with the adhesive. A support region by which the transporting belt 5 supports the medium M coincides with an upside region stretched between the driven roller 3 and the driving roller 4. Further, the driving roller 4 is a roller configured to rotate under a driving force from a non-illustrated motor, and the driven roller 3 is a roller configured to rotate in response to the rotation of the transporting belt 5 in conjunction with causing the driving roller 4 to rotate.

The medium M fed-out from the group of rollers 9 to the transporting belt 5 is pressed by a press roller 6 to be affixed to the support face 5*a*. The press roller 6, which extends in a width direction B intersecting the transport direction A, is configured to be movable in a movement direction D that extends along the transport direction A. In addition, a configuration is employed in which a platen 12 is provided at a lower portion via the transporting belt 5 in a movement range in which the press roller 6 moves, and the medium M and the transporting belt 5 are caused to move, while clamping the medium M and the transporting belt 5 to be pressed by the press roller 6, in the movement direction D toward the platen 12, to make the medium M firmly affixed to the support face 5*a*. That is, the press roller 6 presses the medium M against the transporting belt 5 along the width direction B, to thus cause the medium M to be affixed to the transporting belt 5 in a state of suppressing the occurrence of wrinkles and the like.

The liquid discharging apparatus 1 also includes a carriage 7 configured to be reciprocally movable in the width direction B along a carriage shaft 15 extending in the width direction B, and a head 8 as a liquid discharging unit attached to the carriage 7. The head 8 is configured to discharge an ink as a liquid onto the medium M being transported in the transport direction A. There is provided a platen 14 in a region facing the head 8 with the transporting belt 5 interposed in between. The transporting belt 5, which is supported by the platen 14 in the region facing the head 8, is vibrated in the region facing the head 8 to suppress a deviation of the landing position at which the ink discharged from the head 8 is to land from being deviated, to thus suppress a deterioration of image quality, which is caused by the deviation. Note that a detailed configuration of the platen 14 will be described later.

As such, the liquid discharging apparatus 1 of Example 1 is configured to cause the head 8 to discharge an ink onto the medium M being transported to form an image while causing the carriage 7 to reciprocally move in the width direction B intersecting the transport direction A. The liquid discharging apparatus 1 of Example 1, which includes the carriage 7 thus configured, is configured to repeat transporting the medium M in the transport direction A by a predetermined transport amount and to cause the head 8 to discharge an ink while causing the carriage 7 to move in the width direction B in a state of stopping the medium M, to form a desired image on the medium M.

Note that the liquid discharging apparatus 1 of Example 1 is so-called a serial printer configured to alternately repeat transporting the medium M by a predetermined amount and causing the carriage 7 to reciprocally move to perform printing, and the liquid discharging apparatus 1 may also be so-called a line printer configured to use a line head formed with nozzles in a line shape along the width direction B of the medium M, to successively perform printing while successively transporting the medium M.

Upon being discharged from the liquid discharging apparatus 1 of Example 1, the medium M formed with the image is fed to a drying apparatus for volatilizing constituents contained in the ink discharged onto the medium M, a winding apparatus for winding up the medium M formed with the image, and the like that are provided in stages that follow the liquid discharging apparatus 1 of Example 1.

Here, it is preferred that a textile printed material be used as the medium M. The term "textile printed material" refers to fabrics, garments, other clothing products, and the like on which textile printing is to be performed. The fabrics include natural fibers such as cotton, silk and wool, chemical fibers such as nylon, or composite fibers of the natural fibers and the chemical fibers such as woven clothes, knit fabrics, and non-woven clothes. Also, the garments and other clothing products include sewn products, such as T-shirt, handkerchief, scarf, towel, handbag, fabric bag, and furniture-related products, such as curtain, sheet, and bed cover, as well as fabrics and the like before and after cutting out that are present as parts of the products to be sewn.

Moreover, in addition to the textile printed material described above, exclusive paper dedicated to ink-jet printing, such as plain paper, high quality paper, or glossy paper, and the like may be used as the medium M. In addition, other materials that are usable as the medium M include, for example, plastic films without a surface treatment applied to serve as an ink absorption layer for ink-jet printing, as well as base materials such as paper applied with a coating of plastic materials and base materials bonded with a plastic film. Such plastic materials include, but are not particularly limited to, polyvinyl chloride, polyethylene terephthalate, polycarbonate, polystyrene, polyurethane, polyethylene, and polypropylene, for example.

When the textile printed material is used as the medium M, an ink easily seeps through the textile printed material, which is a phenomenon in which the ink discharged onto the medium M bleeds through to a rear surface of the medium M, and thus there are cases where the transporting belt 5 is stained by the ink. In view of the above, the liquid discharging apparatus 1 of Example 1 includes a cleaning section 10 configured to clean ink deposits having seeped through and adhered to the support face 5*a* of the transporting belt 5. The cleaning section 10 includes a cleaning brush soaked with a cleaning fluid and making contact with the support face 5*a*. The cleaning section 10 also includes an air-blowing section 11 configured, by causing the cleaning brush to make contact with the support face 5*a*, to blow an air to remove the cleaning fluid adhering to the support face 5*a*. Moreover, the liquid discharging apparatus 1 of Example 1 includes a support face heating section 13 configured to heat and dry the cleaning fluid that has not completely been removed by the air-blowing section 11.

The liquid discharging apparatus 1 of Example 1 is configured to cause the driving roller 4 to rotate in the rotation direction C1 to transport the medium M in the transport direction A. The liquid discharging apparatus 1 is also configured to cause the driving roller 4 to rotate in a rotation direction C2, which is an opposite direction from the rotation direction C1, to transport the medium M in an opposite direction from the transport direction A.

Figure 9:
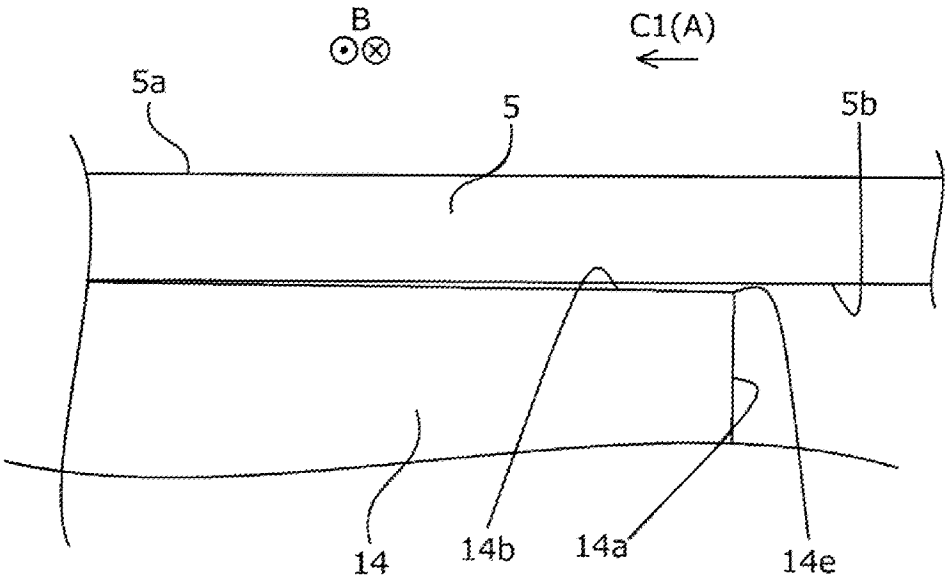
FIG. 9 is an enlarged side view of a printing platen of a liquid discharging apparatus of a reference example.

Next, the platen 14, which is a main portion of the liquid discharging apparatus 1 of Example 1, is described below with reference to FIG. 2, as well as FIG. 9 illustrating the platen 14 used in a liquid discharging apparatus in the related art as a reference example. Here, the platen 14 used in the liquid discharging apparatus in the related art, as well as the platen 14 of the liquid discharging apparatus 1 of Example 1 are each a flat plate for supporting the transporting belt 5 from a side of a contact face 5*b*, where the platen 14 includes an edge 14*e* provided along the width direction B as an extending direction intersecting the transport direction A, where the edge 14*e* is formed by a transporting belt support face 14*b* for supporting the transporting belt 5 and an upstream face 14*a* facing upstream in the rotation direction C1 of the transporting belt 5 when transporting the medium M in the transport direction A.

First, the platen 14 used in the liquid discharging apparatus in the related art will be described with reference to FIG. 9. As illustrated in FIG. 9, the platen 14 in the related art is disposed in a manner that the edge 14*e* extending in the width direction B, which is formed by the transporting belt support face 14*b* and the upstream face 14*a*, avoids abutting against the transporting belt 5. This is because, when disposing the edge 14*e* in a manner abutting against the transporting belt 5, there is a need for alleviating a risk of increasing a transport load when the edge 14*e* gets caught on the contact face 5*b*, and a risk of reducing the life duration of the platen 14, which is caused by a friction with the transporting belt 5.

Figure 2:
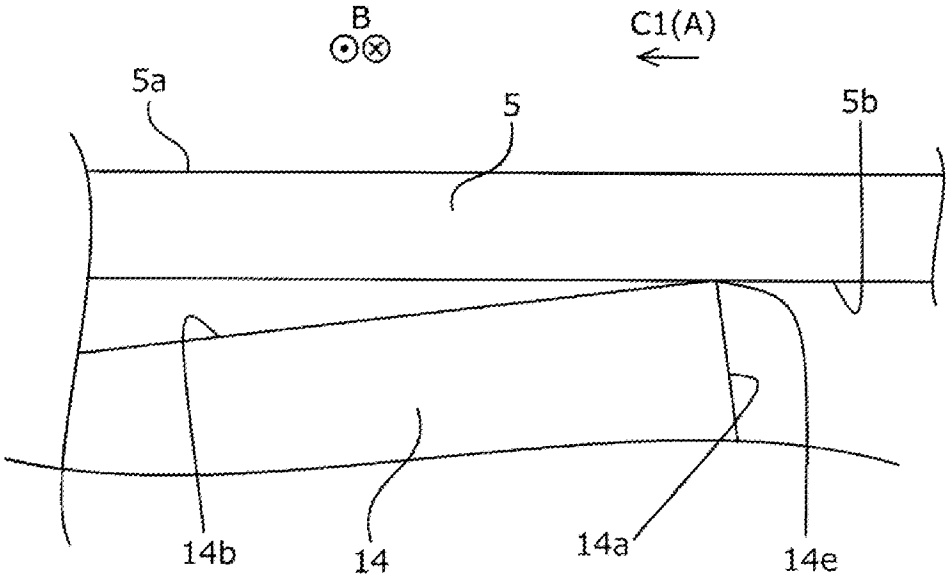
FIG. 2 is an enlarged side view of a printing platen of a liquid discharging apparatus in FIG. 1.

On the other hand, as illustrated in FIG. 2, in the liquid discharging apparatus 1 of Example 1, the platen 14 is disposed in a manner that the edge 14*e* extending in the width direction B, which is formed by the transporting belt support face 14*b* and the upstream face 14*a*, daringly abuts against the transporting belt 5. That is, a design is employed in which the advantage of removing foreign materials adhering to the contact face 5*b* is prioritized over the disadvantage of the increased transport load and reducing the life duration of the platen 14. Accordingly, the platen 14 of the liquid discharging apparatus 1 of Example 1 is disposed with respect to the transporting belt 5 in a manner utterly different from the platen 14 of the liquid discharging apparatus 1 in the related art.

Here, to once summarize, the liquid discharging apparatus 1 of Example 1 includes the transporting belt 5 having an endless shape stretched over the driven roller 3 and the driving roller 4 as the plurality of rollers and configured to rotate while supporting the medium M, by the support face 5*a* being a face on an opposite side from the contact face 5*b* with the driven roller 3 and the driving roller 4, to transport the medium M in the transport direction A, the head 8 configured to discharge an ink onto the medium M supported by the support face 5*a*, and the platen 14 for supporting the transporting belt 5 from a side of the contact face 5*b*. Further, the platen 14 includes the edge 14*e* extending from one end of the transporting belt 5 to the other end of the transporting belt 5 along the width direction B as the extending direction, the edge 14*e* being formed by the transporting belt support face 14*b* for supporting the transporting belt 5 and the upstream face 14*a*, where the edge 14*e* is disposed to abut against the transporting belt 5 along the extending direction.

As such, in the liquid discharging apparatus 1 of Example 1, the edge 14*e* formed at the platen 14 being a flat plate portion, which is disposed to abut against the transporting belt 5 along the extending direction, can remove foreign materials such as an ink adhering to the contact face 5*b* of the transporting belt 5 from the contact face 5*b*.

Accordingly, the liquid discharging apparatus 1 of Example 1 is configured to suppress the driven roller 3 and the driving roller 4 from slipping with respect to the transporting belt 5 to degrade the transport accuracy, and to suppress the degradation of the transport accuracy caused by the transporting belt 5.

Note that although not illustrated in FIGS. 1 and 2, an absorption member is attached, as a foreign material receiving section for receiving the foreign materials such as an ink removed from the contact face 5*b* by absorption, to a lower portion of the edge 14*e*. This makes it possible to suppress the foreign materials from being scattered inside the apparatus to cause a contamination and the like inside the apparatus. The foreign material receiving section of Example 1 is the absorption member, however, for example, a container shaped member or the like may be attached to the lower portion of the edge 14*e*, without the foreign material receiving section being limited to a specific shape and the like.

Further, as illustrated in FIG. 2, the edge 14*e* is provided at an upstream end in the rotation direction C1 of the transporting belt 5 of the platen 14. As such, the liquid discharging apparatus 1 of Example 1, which has a configuration in which an edge is provided at an upstream end of the flat plate portion and has a configuration in which the platen 14 also serves as the flat plate portion having the edge 14*e*, facilitates a formation of the edge without performing complicated processing and without preparing a new, another member.

Note that the edge of Example 1 employs, but not limited to, a configuration that utilizes a corner portion of the upstream end of the flat plate portion as is. For example, the edge may be distinguished by causing the upstream end of the flat plate portion to be warped toward the contact face 5*b*, or may be an edge having concavities and convexities or the like. Here, the term "flat plate portion" used in the present specification is not limited to mean a flat plate having a horizontal plane in a strict sense, but may mean a flat plate having a warpage, concavities and convexities, or the like as long as having a generally flat plate shape.

To describe the platen 14 from another perspective, a flat plate portion that can remove the foreign materials from the contact face 5*b* also serves as the platen 14 provided at a position facing the head 8. The platen 14, which is provided at the position facing the head 8, can suppress the transporting belt 5 at the position facing the head 8 and the medium M supported by the transporting belt 5 from being vibrated, and to suppress a position from which the ink is discharged from being displaced from a desired position due to the vibration of the medium M. This allows the liquid discharging apparatus 1 of Example 1 to suppress the degradation of the transport accuracy caused by the transporting belt 5, and to suppress the discharge position from being displaced from the desired position.

Note that the liquid discharging apparatus 1 of Example 1 employs, but not limited to, a configuration in which the platen 14 also serves as the flat plate portion having the edge 14*e*. For example, a configuration may also be employed in which the platen 12 also serves a flat plate portion having an edge. In the liquid discharging apparatus 1 of Example 1, the platen 12 is also disposed in a manner similar to the platen 14, and also serves as a flat plate portion having an edge for removing the foreign materials from the contact face 5*b*.

Specifically, the platen 12 also includes, as in the platen 14, an edge provided along the width direction B as the extending direction, the edge being formed by a transporting belt support face for supporting the transporting belt 5 and an upstream face, where the edge is disposed to abut against the transporting belt 5 along the extending direction. Further, although not illustrated in FIGS. 1 and 2, the absorption member is also attached, as the foreign material receiving section for receiving the foreign materials removed from the contact face 5*b*, to a lower portion of the edge of the platen 12.

To describe the platen 12 from another perspective, in the liquid discharging apparatus 1 of Example 1, the transporting belt 5 of Example 1 has an adhesive applied at the support face 5*a*, and the medium M is transported in a state of being affixed by the adhesive to the support face 5*a* at least from an affixation position at which the medium M is affixed to the support face 5*a* to a position where the medium passes the region facing the head 8. Further, at the affixation position, there are formed the press roller 6 configured to press the medium M against the support face 5*a* and the platen 12 as the flat plate portion provided at a position facing the press roller 6. As such, the platen 12, which is provided at the position facing the press roller 6, allows the medium M to be pressed against the support face 5*a* in a manner clamping the medium M and the transporting belt 5 between the press roller 6 and the platen 12, and to make the medium M firmly affixed to the support face 5*a*. This allows the liquid discharging apparatus 1 of Example 1 to suppress the degradation of the transport accuracy caused by the transporting belt 5, as well as to suppress the occurrence of affixing failure of the medium M with respect to the support face 5*a*.

Example 2

A new, another member may also be prepared as the flat plate portion. Then, the liquid discharging apparatus 1 of Example 2, in which a new, another member is provided as the flat plate portion, will be described next with reference to FIGS. 3 to 5. Note that in FIGS. 3 to 5, constituent members common to those in Example 1 described above are denoted by the same reference signs, and detailed description for such constituent members will be omitted. Here, the liquid discharging apparatus 1 of Example 2 has a shape similar to that of the liquid discharging apparatus 1 of Example 1 except that the platens 12 and 14 are arranged in a similar manner to the platens 12 and 14 used in the liquid discharging apparatus in the related art and the liquid discharging apparatus 1 of Example 2 further includes a cleaning platen 16 as the flat plate portion and a fan 17.

Figure 3:
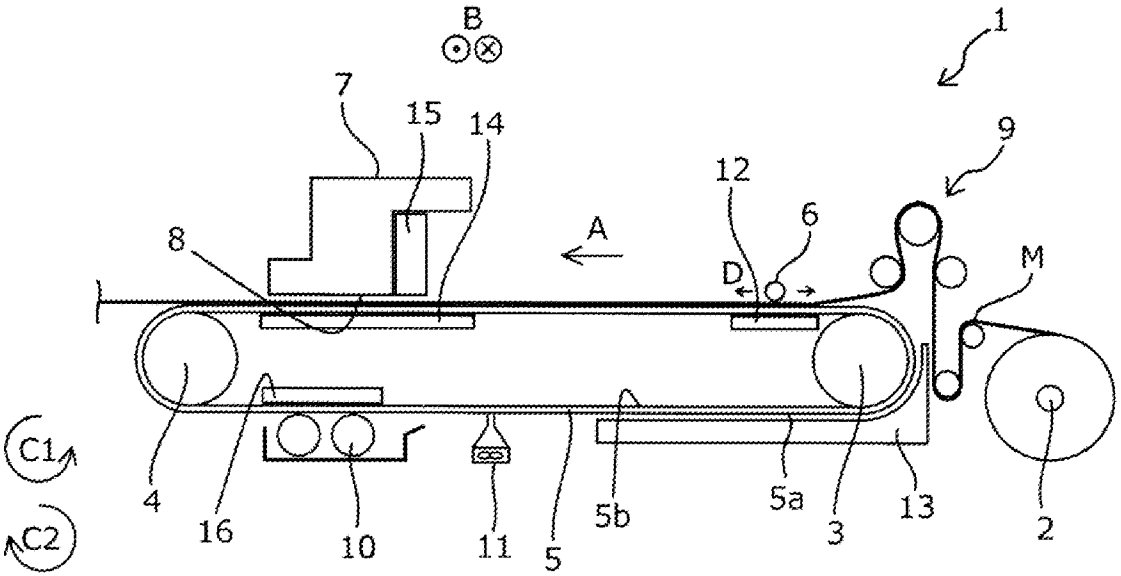
FIG. 3 is a schematic side view of a liquid discharging apparatus according to Example 2 of the present disclosure.
Figure 5:
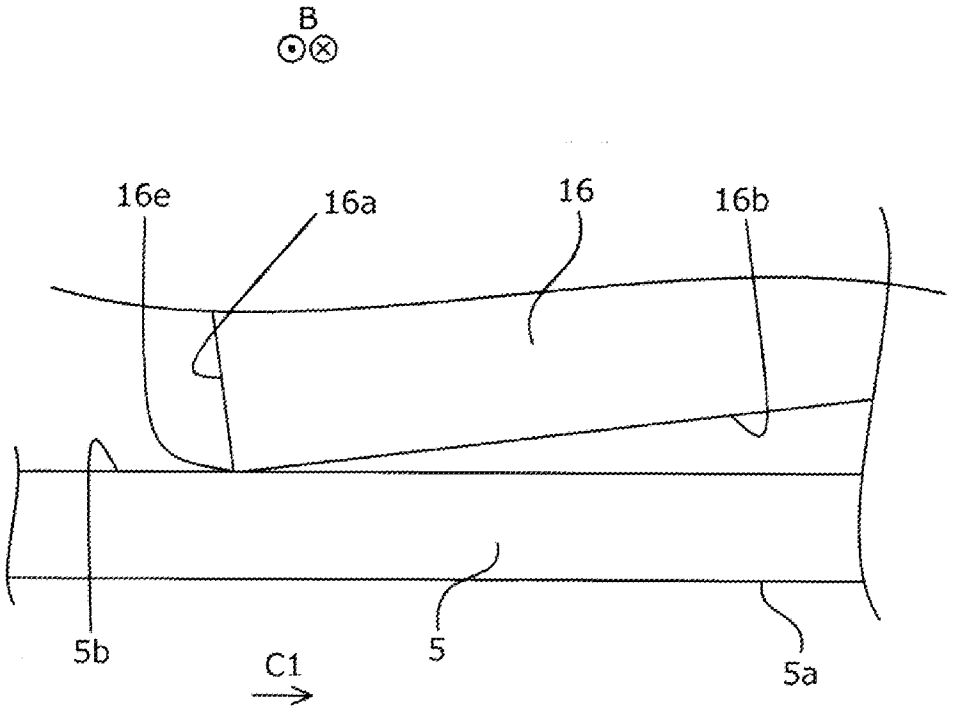
FIG. 5 is an enlarged side view of a cleaning platen of a liquid discharging apparatus in FIG. 3.

As illustrated in FIG. 3, the liquid discharging apparatus 1 of Example 2 includes the cleaning platen 16 at a position on the side of the contact face 5*b* at an upper portion of the cleaning section 10. As illustrated in FIG. 5, the cleaning platen 16 is disposed in a manner that an edge 16*e* extending in the extending direction, which is formed by a transporting belt support face 16*b* and an upstream face 16*a*, abuts against the transporting belt 5.

Figure 4:
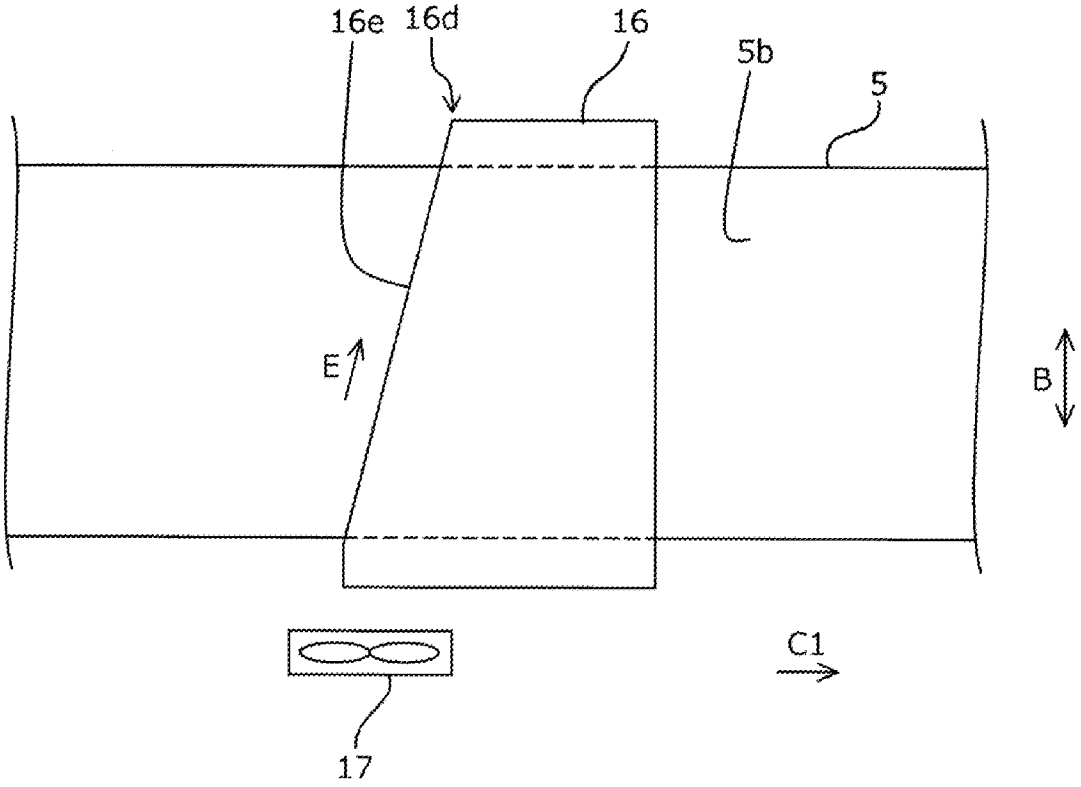
FIG. 4 is a schematic plan view of a cleaning platen of a liquid discharging apparatus in FIG. 3.

Here, as illustrated in FIG. 4, the extending direction in which the edge 16*e* extends is out of alignment with respect to the width direction B of the transporting belt 5, which is orthogonal to the transport direction A. The liquid discharging apparatus 1 of Example 2, in which the extending direction in which the edge 16*e* extends is out of alignment with respect to the width direction B of the transporting belt 5, allows, in conjunction with causing the transporting belt 5 to rotate, the foreign materials removed by the edge 16*e* to automatically move in a movement direction E toward a width direction end portion 16*d* located downstream in the rotational direction. This makes it possible to facilitate a movement of the foreign materials removed by the edge 16*e*, and to suppress the foreign materials from accumulating at the edge 16*e*.

Further, as described above, the cleaning platen 16, which is provided at the upper portion of the cleaning section 10, causes the foreign materials having moved to the width direction end portion 16*d* falls down to a cleaning fluid tank for containing a cleaning fluid in the cleaning section 10. That is, the cleaning section 10 also serves as the foreign material receiving section for receiving the foreign materials adhering to the edge 16*e*. As such, the liquid discharging apparatus 1 of Example 2, which includes the foreign material receiving section for receiving the foreign materials adhering to the edge 16*e*, is configured to suppress the foreign materials from being scattered inside the apparatus to cause a contamination and the like inside the apparatus.

As described above, the liquid discharging apparatus 1 of Example 2, in which the extending direction in which the edge 16*e* extends is out of alignment with respect to the width direction B, is configured to allow, in conjunction with causing the transporting belt 5 to rotate, the foreign materials removed by the edge 16*e* to automatically move in the movement direction E, and includes, in order to assist the movement of the foreign materials, the fan 17 configured to blow an air to assist the movement of the foreign materials, as illustrated in FIG. 4. In other words, the liquid discharging apparatus 1 of Example 2 includes the fan 17 as the movement section configured to move the foreign materials adhering to the edge 16*e* toward the cleaning section 10. Accordingly, the liquid discharging apparatus 1 of Example 2 is configured to allow the foreign materials to be received by the cleaning section 10 with high accuracy, and to efficiently suppress the foreign materials from being scattered inside the apparatus to cause a contamination and the like inside the apparatus.

Note that the liquid discharging apparatus 1 of Example 2 includes the cleaning section 10 configured to clean the transporting belt 5, where the cleaning section 10 is configured to also serve as the foreign material receiving section, thus enabling to suppress, by separately forming the cleaning section and the foreign material receiving section, the apparatus configuration from being complexed. However, the cleaning section and the foreign material receiving section may be separately formed without being limited to such a configuration.

Example 3

Figure 6:
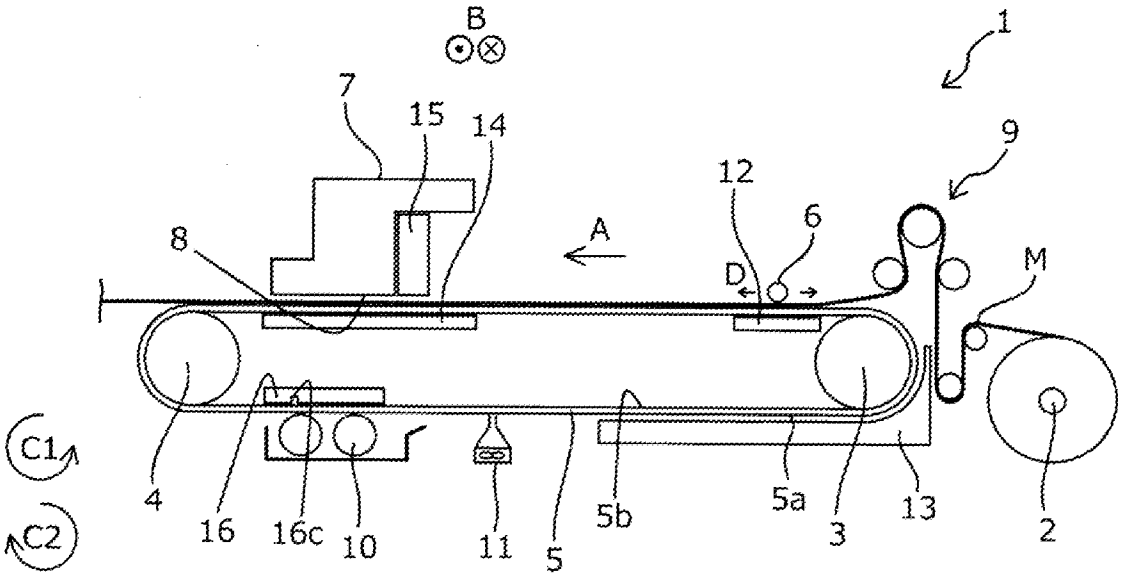
FIG. 6 is a schematic side view of a liquid discharging apparatus according to Example 3 of the present disclosure.
Figure 7:
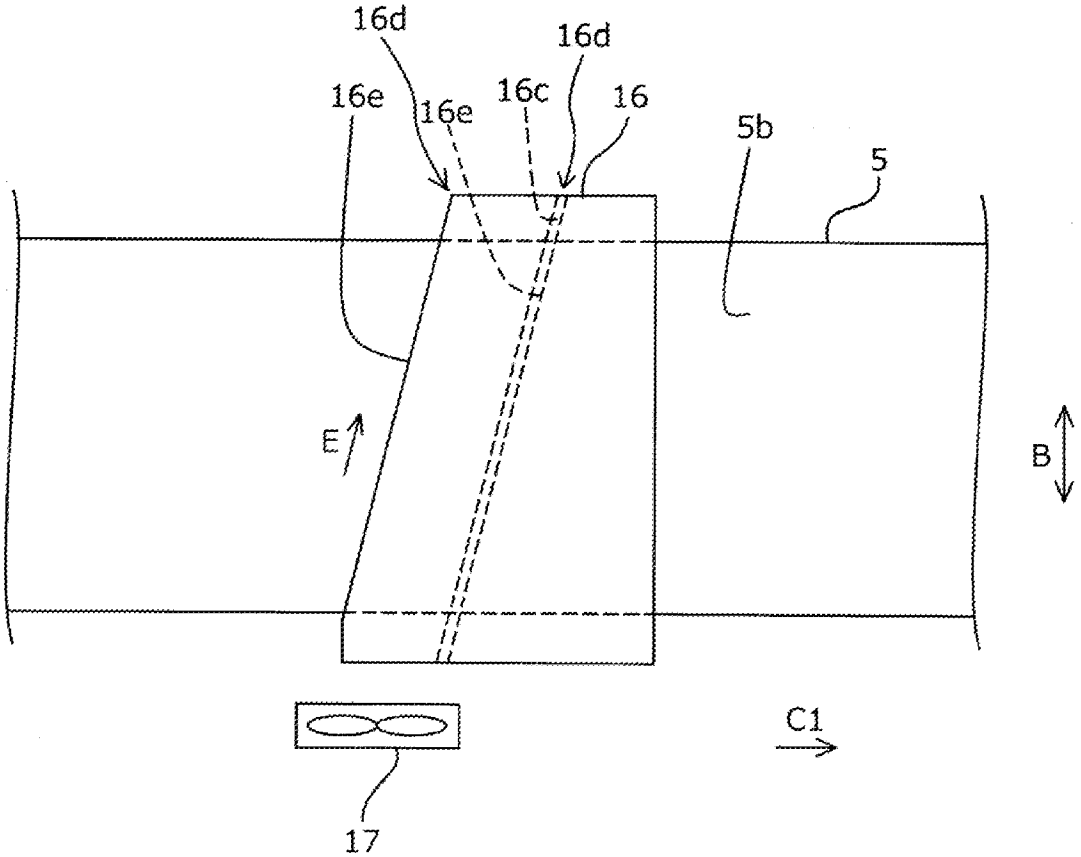
FIG. 7 is a schematic plan view of a cleaning platen of a liquid discharging apparatus of FIG. 6.
Figure 8:
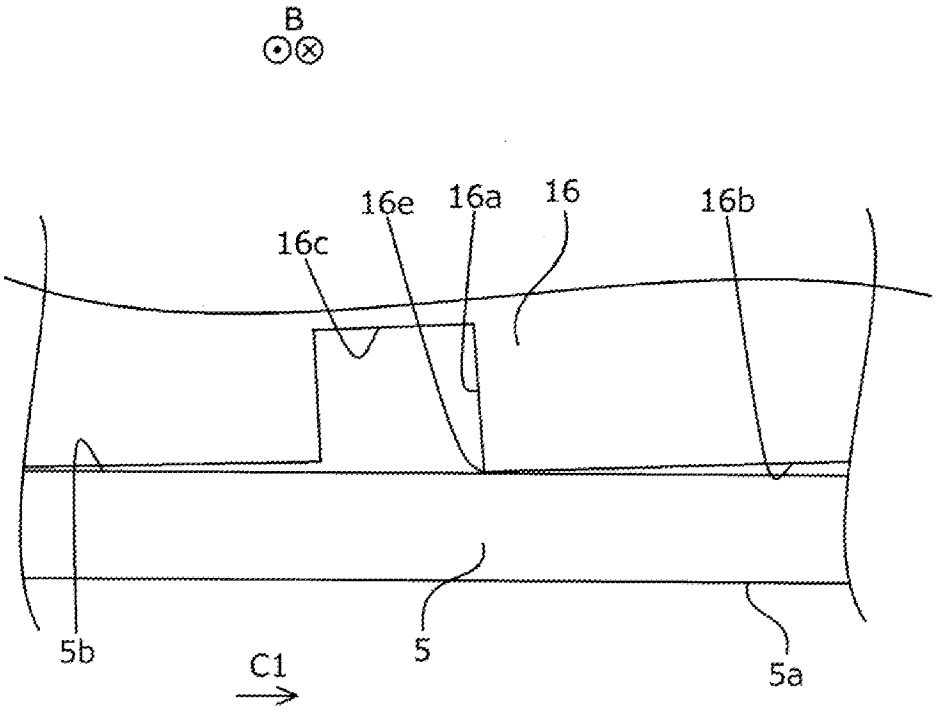
FIG. 8 is an enlarged side view of a cleaning platen of a liquid discharging apparatus of FIG. 6.

Next, the liquid discharging apparatus 1 of Example 3 will be described with reference to FIGS. 6 to 8. Note that in FIGS. 6 to 8, constituent members common to those in Examples 1 and 2 described above are denoted by the same reference signs, and detailed description for such constituent members are omitted. Here, the liquid discharging apparatus 1 of Example 3 has a shape similar to that of the liquid discharging apparatus 1 of Example 2, excluding the configuration of the cleaning platen 16, As illustrated in FIGS. 6 to 8, the cleaning platen 16 of Example 3 includes a groove 16*c* provided along the extending direction. Further, the edge 16*e* formed in the groove 16*c* is formed by the transporting belt support face 16*b* and the upstream face 16*a* facing upstream in the groove 16*c*, as illustrated in FIG. 8. In the liquid discharging apparatus 1 of Example 3, the groove 16*c* of the flat plate portion, which is also provided with the edge 16*e*, can receive the foreign materials removed by the edge 16*e* formed in the groove 16*c*.

The liquid discharging apparatus 1 of Example 3 is configured to effectively remove the foreign materials by two edges, which are constituted by the edge 16*e* formed at a width direction end portion in the rotation direction C1 of the cleaning platen 16 and the edge 16*e* formed in the groove 16*c*. Note that, as illustrated in FIG. 7, a configuration is employed in which the two edges 16*e* are both formed such that the extending direction is out of alignment with respect to the width direction B of the transporting belt 5, thus allowing, in conjunction with causing the transporting belt 5 to rotate, the foreign materials removed by the two edges 16*e* to automatically move in the movement direction E toward the width direction end portion 16*d* located downstream in the rotational direction. In addition, the fan 17, which serves as the movement section for causing the foreign materials to move toward the cleaning section 10, is configured to move the foreign materials adhering to both of the two edges 16*e* together in the movement direction E.

Note that the present disclosure is not limited to the aforementioned examples, and many variations are possible within the scope of the disclosure as described in the appended claims. It goes without saying that such variations also fall within the scope of the disclosure.

What is claimed is:

1. A liquid discharging apparatus comprising:

a transporting belt having an endless shape stretched over a plurality of rollers and configured to rotate while supporting a medium, by a support face being a face on an opposite side from a contact face with the roller, to transport the medium in a transport direction;

a liquid discharging unit configured to discharge a liquid onto the medium supported by the support face; and a flat plate portion for supporting the transporting belt from a side of the contact face, wherein the flat plate portion includes an edge extending from one end of the transporting belt to the other end of the transporting belt along an extending direction intersecting the transport direction, the edge being formed by a transporting belt support face for supporting the transporting belt and a face facing upstream in a rotation direction of the transporting belt when transporting the medium in the transport direction, the edge is disposed to abut against the transporting belt along the extending direction, and the flat plate portion includes a groove provided along the extending direction, and the edge is formed by the transporting belt support face and a face, facing upstream, in the groove.

2. The liquid discharging apparatus according to claim 1, wherein the edge is provided at an upstream end of the flat plate portion.

3. The liquid discharging apparatus according to claim 1, wherein the flat plate portion is provided at a position facing the liquid discharging unit.

4. The liquid discharging apparatus according to claim 1, wherein the transporting belt has an adhesive applied at the support face, the medium is transported in a state of being affixed by the adhesive to the support face at least from an affixation position at which the medium is affixed to a position where the medium passes a region facing the liquid discharging unit, and at the affixation position, a press roller configured to press the medium against the support face and the flat plate portion provided at a position facing the press roller are formed.

5. A liquid discharging apparatus comprising:

a transporting belt having an endless shape stretched over a plurality of rollers and configured to rotate while supporting a medium, by a support face being a face on an opposite side from a contact face with the roller, to transport the medium in a transport direction;

a liquid discharging unit configured to discharge a liquid onto the medium supported by the support face; and a flat plate portion for supporting the transporting belt from a side of the contact face, wherein the flat plate portion includes an edge extending from one end of the transporting belt to the other end of the transporting belt along an extending direction intersecting the transport direction, the edge being formed by a transporting belt support face for supporting the transporting belt and a face facing upstream in a rotation direction of the transporting belt when transporting the medium in the transport direction, the edge is disposed to abut against the transporting belt along the extending direction, and the extending direction in which the edge extends is out of alignment with respect to a width direction of the transporting belt, the width direction being orthogonal to the transport direction.

6. A liquid discharging apparatus comprising:

a transporting belt having an endless shape stretched over a plurality of rollers and configured to rotate while supporting a medium, by a support face being a face on an opposite side from a contact face with the roller, to transport the medium in a transport direction;

a liquid discharging unit configured to discharge a liquid onto the medium supported by the support face; and a flat plate portion for supporting the transporting belt from a side of the contact face, wherein the flat plate portion includes an edge extending from one end of the transporting belt to the other end of the transporting belt along an extending direction intersecting the transport direction, the edge being formed by a transporting belt support face for supporting the transporting belt and a face facing upstream in a rotation direction of the transporting belt when transporting the medium in the transport direction, the edge is disposed to abut against the transporting belt along the extending direction, a foreign material receiving section for receiving a foreign material adhering to the edge is provided, and a movement section is provided that is configured to move the foreign material adhering to the edge toward the foreign material receiving section.

7. The liquid discharging apparatus according to claim 6, comprising a cleaning section configured to clean the transporting belt, wherein the cleaning section also serves as the foreign material receiving section.

* * * * *